US006974311B2

(12) United States Patent
Sakai et al.

(10) Patent No.: US 6,974,311 B2
(45) Date of Patent: Dec. 13, 2005

(54) CONTROL VALVE

(75) Inventors: Takayuki Sakai, Ogaki (JP); Satoru Okada, Ogaki (JP)

(73) Assignee: Pacific Industrial Co., Ltd., Gifu-ken (JP)

( * ) Notice: Subject to any disclaimer, the term of this patent is extended or adjusted under 35 U.S.C. 154(b) by 420 days.

(21) Appl. No.: 10/444,233

(22) Filed: May 23, 2003

(65) Prior Publication Data

US 2003/0219344 A1 Nov. 27, 2003

(30) Foreign Application Priority Data

May 27, 2002 (JP) ..... 2002-152070

(51) Int. Cl.[7] ..... F04B 1/29
(52) U.S. Cl. ..... 417/222.2
(58) Field of Search ..... 417/222.2

(56) References Cited

U.S. PATENT DOCUMENTS 5,165,863 A * 11/1992 Taguchi ..... 417/222.2
6,244,159 B1 6/2001 Kimura et al.
6,354,811 B1 * 3/2002 Ota et al. ..... 417/222.2
6,485,267 B1 11/2002 Imai et al.
2004/0086391 A1 * 5/2004 Hirota et al. ..... 417/222.2

FOREIGN PATENT DOCUMENTS

| | | |
|---|---|---|
| JP | 11-218078 | 8/1999 |
| JP | 2000-120912 | 4/2000 |
| KR | 10 2000 0011236 | 2/2000 |
| KR | 10 2001 0039973 | 5/2001 |

* cited by examiner

*Primary Examiner*—Michael Koczo, Jr.
(74) *Attorney, Agent, or Firm*—Godfrey & Kahn, S.C.

(57) ABSTRACT

A control valve for a variable displacement compressor has a solenoid, a pressure sensing mechanism, and a valve mechanism. The solenoid has a first end and a second end and a cylindrical body. The pressure sensing mechanism is located on the first end of the solenoid. The pressure sensing mechanism has a pressure sensing chamber and a diaphragm. The diaphragm is displaced in accordance with the pressure in the pressure sensing chamber. The valve mechanism is located on the second end of the solenoid. The cylindrical body has a support end, which supports the diaphragm.

17 Claims, 1 Drawing Sheet

CONTROL VALVE

BACKGROUND OF THE INVENTION

The present invention relates to a control valve for controlling displacement of a variable displacement compressor used for a vehicular air-conditioner.

A typical variable displacement compressor used in a refrigerant circuit includes a crank chamber; a swash plate, which is tiltably located inside the crank chamber; and pistons, which reciprocate by operation of the swash plate. The inclination angle of the swash plate changes in accordance with the pressure in the crank chamber (crank pressure). Each piston moves by a stroke that corresponds to the inclination angle of the swash plate. The displacement of the compressor varies in accordance with the stroke of the pistons.

A control valve is located in the compressor to adjust the crank pressure. The control valve is, for example, located in a supply passage, which connects a discharge chamber of the compressor to the crank chamber. The control valve adjusts the amount of refrigerant gas supplied to the crank chamber through the supply passage from the discharge chamber in accordance with the pressure (suction pressure) of refrigerant gas drawn into the compressor from an evaporator located in the refrigerant circuit.

The control valve includes a pressure sensing mechanism, a valve mechanism, and a solenoid. The pressure sensing mechanism detects the suction pressure and is displaced in accordance with the pressure. The valve mechanism changes the opening degree of a valve hole by the displacement of the pressure sensing mechanism and adjusts the amount of refrigerant gas that flows through the supply passage. The solenoid controls, by exciting a coil, the opening degree of the valve hole in accordance with the suction pressure. The valve mechanism is generally located at the center of the control valve. The pressure sensing mechanism is located at one end of the valve mechanism and the solenoid is located at the other end of the valve mechanism.

Japanese Laid-Open Patent Publication No. 11-218078 and No. 2000-120912 disclose a control valve in which a solenoid is located at the center of the control valve. In the control valve of the publications, a pressure sensing mechanism is located on one end of the solenoid and a valve mechanism is located on the other end of the solenoid. With this structure, the solenoid can be accommodated in a housing of a compressor. Thus, refrigerant gas that has relatively low temperature and that is drawn into the compressor from the evaporator is introduced in the vicinity of the solenoid. Accordingly, the solenoid, which becomes heated due to excitation of a coil, is cooled. As a result, the electromagnetic force of the coil is prevented from decreasing due to the heat of the coil, and the size of the solenoid is reduced, which reduces the size of the control valve.

In the control valve of the publications, a bellows is used as a member for forming the pressure sensing mechanism. Since the manufacturing cost of the bellows is relatively expensive, the bellows is hindered to decrease the manufacturing cost of the control valve. Therefore, a control valve has been proposed that uses a diaphragm, which is manufactured at a lower cost than the bellows. When the diaphragm is used, the diaphragm is displaced in accordance with the suction pressure and the displacement amount is transmitted to a valve body, which selectively opens and closes a valve hole. Since the relationship between the displacement amount of the diaphragm and the suction pressure is not proportional, the fixing position of the diaphragm with respect to the valve hole needs to be set with high accuracy to obtain desired operating characteristics of the control valve.

However, in the control valve in which the solenoid is located at the center, the distance between the diaphragm and the valve hole is long. Therefore, the number of parts located between the diaphragm and the valve hole is increased. As a result, the fixing position of the diaphragm is displaced from the desired position due to the dimensional error and the assembling error of each part. Accordingly, the control accuracy of the control valve is decreased.

SUMMARY OF THE INVENTION

Accordingly, it is an objective of the present invention to provide a control valve that is manufactured at a low cost and that controls the displacement of a compressor with high accuracy.

To achieve the above objective, the present invention provides a control valve for a variable displacement compressor. The compressor includes a discharge pressure zone, a suction pressure zone, a crank chamber, and a supply passage, which communicates the discharge pressure zone with the crank chamber. The compressor has a variable displacement. The crank chamber and the suction pressure zone have pressures. A control valve is located in the supply passage and controls the displacement of the compressor by adjusting the pressure in the crank chamber. The control valve includes a solenoid, a pressure sensing mechanism, and a valve mechanism. The solenoid has a first end and a second end. The solenoid has a cylindrical body and a coil, which is located about the cylindrical body. The pressure sensing mechanism is located on the first end of the solenoid. The pressure sensing mechanism has a pressure sensing chamber and a diaphragm. The pressure in the suction pressure zone is introduced into the pressure sensing chamber. The diaphragm is displaced in accordance with the pressure in the pressure sensing chamber. The valve mechanism is located on the second end of the solenoid. The valve mechanism has a valve hole, which forms part of the supply passage, and a valve body, which selectively opens and closes the valve hole in accordance with displacement of the diaphragm. The cylindrical body has a support end, which supports the diaphragm.

Other aspects and advantages of the invention will become apparent from the following description, taken in conjunction with the accompanying drawings, illustrating by way of example the principles of the invention.

BRIEF DESCRIPTION OF THE DRAWING

The invention, together with objects and advantages thereof, may best be understood by reference to the following description of the presently preferred embodiments together with the accompanying drawing in which.

DETAILED DESCRIPTION OF THE PREFERRED EMBODIMENTS

Figure 1:
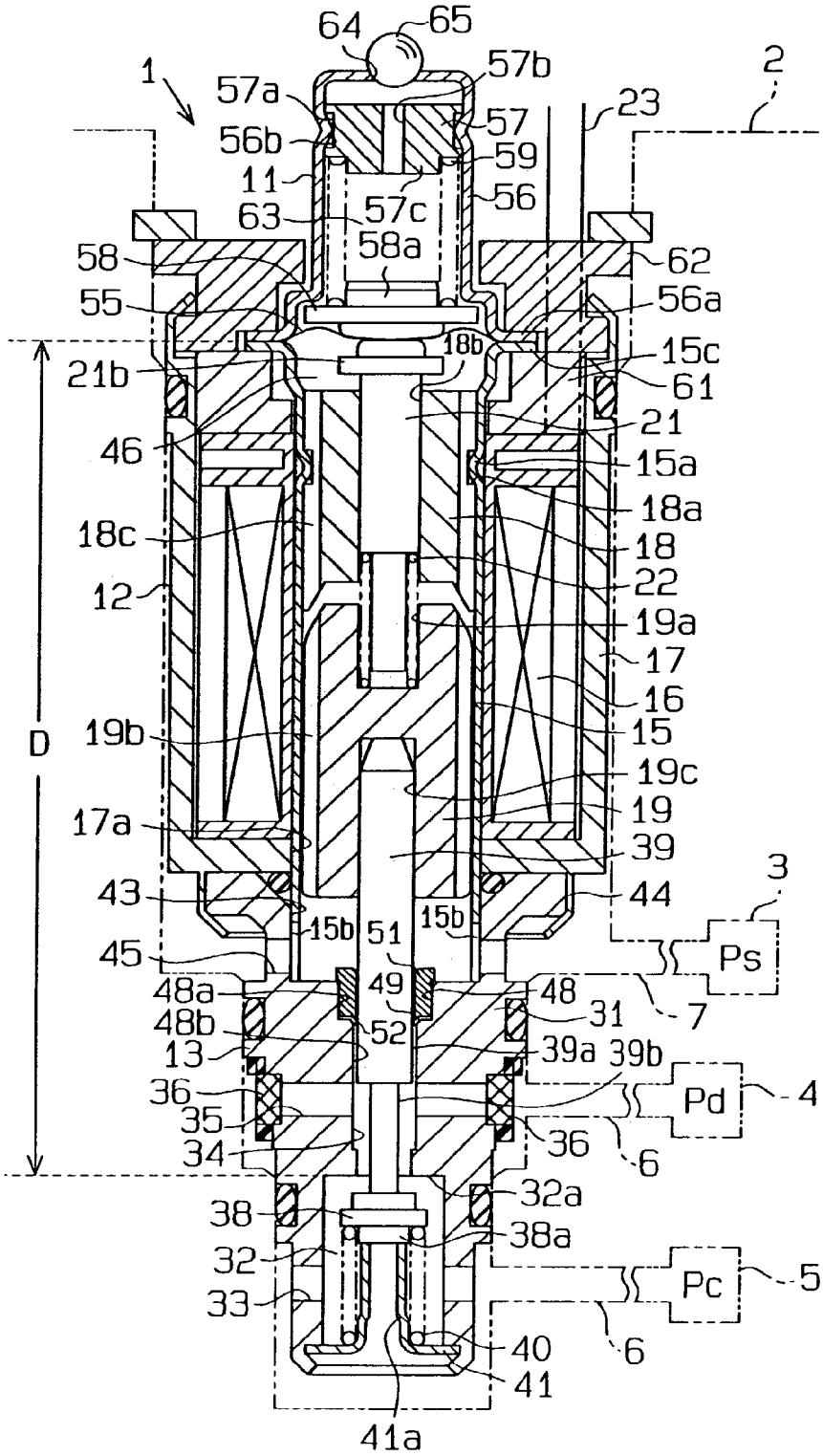
FIG. 1 is a cross-sectional view illustrating a control valve according to a preferred embodiment of the present invention.

A preferred embodiment of the present invention will now be described with reference to FIG. 1.

A control valve 1 shown in FIG. 1 is attached to a variable displacement compressor 2 incorporated in a refrigerant circuit. Although a specific structure of the variable displacement compressor 2 is not shown in FIG. 1, the variable displacement compressor 2 includes a suction chamber (suction pressure zone) 3, which is exposed to a suction pressure Ps; a discharge chamber (discharge pressure zone) 4, which is exposed to a discharge pressure Pd; and a crank chamber 5, which is exposed to a crank pressure Pc. The crank chamber 5 accommodates a tiltable swash plate (not shown). When a drive shaft of the compressor 2 is rotated, the swash plate causes pistons to reciprocate. Refrigerant gas is introduced into the suction chamber 3 from an evaporator, which is located in the refrigerant circuit. Each piston is accommodated in a cylinder bore and draws refrigerant gas in the suction chamber 3 into the corresponding cylinder bore. Each piston compresses refrigerant gas in the corresponding cylinder bore and discharges the compressed refrigerant gas to the discharge chamber 4. The compressed refrigerant gas in the discharge chamber 4 is sent out to the refrigerant circuit.

The compressor 2 includes a supply passage 6, which connects the discharge chamber 4 to the crank chamber 5. The control valve 1 is located in the supply passage 6. The control valve 1 adjusts the amount of refrigerant gas supplied to the crank chamber 5 from the discharge chamber 4 through the supply passage 6 in accordance with the suction pressure Ps introduced from the suction chamber 3 through a pressure introduction passage 7.

The control valve 1 includes a pressure sensing mechanism 11, a solenoid 12, and a valve mechanism 13. The solenoid 12 is located at the center of the control valve 1. The pressure sensing mechanism 11 is located at a first end (the upper end as viewed in FIG. 1) of the solenoid 12 and the valve mechanism 13 is located at a second end (the lower end as viewed in FIG. 1) of the solenoid 12.

The solenoid 12 includes a cylindrical body, which is a plunger tube 15 in the preferred embodiment; a coil 16; an iron solenoid cover 17; a stationary iron core, which is a stationary core 18 in the preferred embodiment; and a movable iron core, which is a plunger 19 in the preferred embodiment.

The plunger tube 15 extends along the entire length of the solenoid 12. The stationary core 18 is inserted in the plunger tube 15. The plunger 19 is accommodated in the plunger tube 15 below the stationary core 18. The plunger 19 moves along the axial direction of the plunger tube 15. An engaging groove 18*a* is formed on an outer surface of the stationary core 18. An engaging projection 15*a* is formed on the plunger tube 15 by caulking. The engaging projection 15*a* projects radially inward of the plunger tube 15. The portion of the outer surface of the plunger tube 15 that corresponds to the engaging groove 18*a* is caulked while the stationary core 18 is located at a predetermined position with respect to the plunger tube 15. This forms the engaging projection 15*a*, which engages with the engaging groove 18*a*. When the engaging projection 15*a* engages with the engaging groove 18*a*, the stationary core 18 is secured to the plunger tube 15.

A through hole 18*b* is formed at the center of the stationary core 18. The through hole 18*b* extends in the vertical direction as viewed in FIG. 1 (the axial direction of the plunger tube 15). A pressure sensing shaft 21 is inserted in the through hole 18*b*. The pressure sensing shaft 21 slides along the through hole 18*b*. An accommodating hole 19*a* is formed at the center of the upper end of the plunger 19. The accommodating hole 19*a* accommodates the lower end of the pressure sensing shaft 21 and a spring 22. The diameter of the accommodating hole 19*a* is substantially the same as the diameter of the through hole 18*b* of the stationary core 18. The pressure sensing shaft 21 includes a large diameter portion, which is located at the upper portion of the pressure sensing shaft 21, and a small diameter portion, which is located at the lower portion of the pressure sensing shaft 21. The spring 22 is located about the small diameter portion. The small diameter portion of the pressure sensing shaft 21 is accommodated in the accommodating hole 19*a* of the plunger 19 with the spring 22. The spring 22 urges the plunger 19 in a direction to separate the plunger 19 from the stationary core 18. The small diameter portion of the pressure sensing shaft 21 is not fixed to the plunger 19. Therefore, when the spring 22 is extended and the distance between the end of the large diameter portion of the pressure sensing shaft 21 and the bottom surface defining portion of the accommodating hole 19*a* becomes longer than the axial length of the small diameter portion of the pressure sensing shaft 21, the pressure sensing shaft 21 separates from the plunger 19.

The coil 16 is located at the outer circumference of the plunger tube 15. An electric supply line 23 is connected to the coil 16 to supply exciting current. The solenoid cover 17 is cup-shaped and covers the coil 16. A bore 17*a* is formed at the center of the bottom surface of the solenoid cover 17. The lower end of the plunger tube 15 projects from the bore 17*a*.

The valve mechanism 13 will be described below.

A valve chamber 32 is located at the lower portion of a valve housing 31 of the valve mechanism 13. The valve housing 31 has a crank pressure port 33, which is communicated with the valve chamber 32; a valve hole 34, which is communicated with the valve chamber 32; and a discharge pressure port 35, which is communicated with the valve hole 34. A strainer 36 is attached to the inlet of the discharge pressure port 35. The valve chamber 32 includes a ceiling 32*a*, which defines part of the valve chamber 32.

The valve chamber 32 is connected to the crank chamber 5, via the crank pressure port 33 and a downstream portion of the supply passage 6. Therefore, the crank pressure Pc is introduced into the valve chamber 32 via the crank pressure port 33. The valve hole 34 is connected to the discharge chamber 4, via the discharge pressure port 35 and the upstream portion of the supply passage 6. Therefore, the discharge pressure Pd is introduced into the valve hole 34 via the discharge pressure port 35. The valve chamber 32, the valve hole 34, and the ports 33, 35 function as internal passage located inside the valve housing 31 forming part of the supply passage 6.

A rod 39 is accommodated inside the plunger tube 15 and the valve housing 31. The rod 39 is movable along the axial direction of the plunger tube 15. A valve body 38 is accommodated in the valve chamber 32. The valve body 38 is located at the distal end of the rod 39. A spring 40 is located in the valve chamber 32 to urge the valve body 38 toward the valve hole 34. A spring receiver 41 for receiving the spring 40 is located inside the valve chamber 32. The spring receiver 41 has a cylinder 41*a*, which extends along the axial direction of the valve housing 31. The cylinder 41*a* is arranged radially inward of the valve housing 31 from the position where the spring 40 is located. The spring 40 is prevented from tilting by the cylinder 41*a*. A columnar fitting projection 38*a* is located below the valve body 38. The spring 40 is fitted to the fitting projection 38*a*. The valve body 38 is prevented from moving downward when the fitting projection 38*a* of the valve body 38 abuts against the cylinder 41*a* of the spring receiver 41.

A fitting recess 43 is formed at the upper end of the valve housing 31. The lower end of the plunger tube 15 that projects from the bottom of the solenoid cover 17 is fitted to the fitting recess 43. A fastener 44 is located at the bottom of the solenoid cover 17 for securing the valve housing 31 by sandwiching the upper end of the valve housing 31. The distal end of the fastener 44 is bent inward by caulking.

A cut-out portion 15*b* is formed at the lower end of the plunger tube 15. The valve housing 31 has a suction pressure port 45, which is communicated with the plunger tube 15 via the cut-out portion 15*b*.

A first communication groove 19*b* is formed on the outer circumferential surface of the plunger 19. The first communication groove 19*b* extends along the axial direction of the plunger 19. A second communication groove 18*c* is formed on the outer circumferential surface of the stationary core 18. The second communication groove 18*c* extends along the axial direction of the stationary core 18. A pressure sensing chamber 46 is formed above the stationary core 18 inside the plunger tube 15. The pressure sensing chamber 46 is connected to the suction pressure port 45 via the first and second communication grooves 19*b*, 18*c*. The suction pressure port 45 is connected to the suction chamber 3 via the pressure introduction passage 7. Therefore, the suction pressure Ps is introduced into the pressure sensing chamber 46 via the suction pressure port 45 and the first and second communication grooves 19*b*, 18*c*.

A rod hole 48 is formed at the center of the valve housing 31. The rod hole 48 extends along the axial direction of the valve housing 31. The rod hole 48 has a large diameter portion 48*a*, which is communicated with the internal space of the plunger tube 15, and a small diameter portion 48*b*, which is located below the large diameter portion 48*a* and communicated with the valve hole 34.

The rod 39 has a large diameter portion 39*a* and a small diameter portion 39*b*. The large diameter portion 39*a* and the small diameter portion 39*b* are inserted in the rod hole 48 and the valve hole 34, respectively. More specifically, the upper end of the large diameter portion 39*a* is inserted in a fitting bore 19*c*, which is formed in the plunger 19, and the lower end of the large diameter portion is inserted in the rod hole 48. The diameter of the large diameter portion 39*a* is substantially the same or slightly less than the diameter of the small diameter portion 48*b* of the rod hole 48. The small diameter portion 39*b* extends downward from the lower end of the large diameter portion 39*a* and is inserted in the valve hole 34. The valve body 38 is located at the lower end of the small diameter portion 39*b*. The plunger 19, the rod 39, and the valve body 38 moves integrally with one another.

A corner 49 is formed at the boundary between the small diameter portion 48*b* and the large diameter portion 48*a* of the rod hole 48. The corner 49 is inclined such that the diameter of a portion close to the valve hole 34 is less than the diameter of a portion close to the rod hole 48. A cylindrical bush 51 is press fitted in the large diameter portion 48*a* of the rod hole 48. The bush 51 has a through hole, which permits the large diameter portion 39*a* of the rod 39 to extend through. The bush 51 has a tapered surface that faces the corner 49.

An annular sealing plate 52 is sandwiched between the surface of the corner 49 and the tapered surface of the bush 51. The sealing plate 52 has a through hole, which permits the large diameter portion 39*a* of the rod 39 to extend through. The sealing plate 52 is formed of elastic resin material and is substantially flat before being attached to the control valve 1. When the sealing plate 52 is sandwiched between the surface of the corner 49 and the tapered surface of the bush 51, the sealing plate 52 is bent to be tapered along the surface of the corner 49 and the tapered surface. When the rod 39 is attached to the control valve 1, the inner circumferential edge of the sealing plate 52 is in close contact with the large diameter portion 39*a* of the rod 39 by the elasticity of the sealing plate 52. The inner portion of the plunger tube 15, which is exposed to the suction pressure Ps, and the valve hole 34, which is exposed to the discharge pressure Pd, are separated by the sealing plate 52.

The pressure sensing mechanism 11 will now be described.

The pressure sensing mechanism 11 includes a diaphragm 55 in the preferred embodiment; a cylindrical case 56; an adjuster 57, which is secured inside the case 56; a dolly block 58, which is arranged above the diaphragm 55; and an adjuster spring 59, which is arranged between the adjuster 57 and the dolly block 58 to urge the dolly block 58 toward the diaphragm 55. The diaphragm 55 is formed of resin material. The diaphragm 55 may also be formed of metal material.

A support end, which is a first flange 15*c* is formed integrally with the upper end of the plunger tube 15 of the solenoid 12 and extends radially outward from the plunger tube 15. The case 56 is open downward. A second flange 56*a* is formed integrally with the lower end of the case 56 and extends radially outward from the case 56. The diaphragm 55 is retained between the second flange 56*a* of the case 56 and the first flange 15*c* of the plunger tube 15. The second flange 56*a* of the case 56 and the first flange 15*c* of the plunger tube 15 are integrated by welding (for example, plasma welding, laser welding, or beam welding) the flanges 56*a*, 15*c* while retaining the diaphragm 55 in between.

A yoke 61 is arranged above the coil 16 inside the solenoid cover 17. The first flange 15*c* of the plunger tube 15 is supported by the upper surface of the yoke 61. A holder 62 is placed on the upper surface of the yoke 61 to close the opening of the solenoid cover 17. The pressure sensing mechanism 11 is secured to the solenoid 12 by sandwiching the flanges 15*c*, 56*a* with the yoke 61 and the holder 62, and calking the upper end of the solenoid cover 17.

The case 56 and the diaphragm 55 define a control chamber 63. The pressure in the control chamber 63 is maintained at a predetermined standard pressure (or preferably a vacuum). The case 56 has a pressure setting hole, which is a ceiling hole 64 in the preferred embodiment. The ceiling hole 64 is closed by a ceiling body 65. The ceiling hole 64 is preferably circular and the ceiling body 65 is preferably spherical.

The adjuster 57, the dolly block 58, and the adjuster spring 59 are arranged inside the control chamber 63. An engaging groove 57*a* is formed on the outer surface of the adjuster 57. An engaging projection 56*b* is formed on the case 56 and projects radially inward of the case 56. The engaging projection 56*b* is formed by caulking. The adjuster 57 is secured to the case 56 when the engaging projection 56*b* engages with the engaging groove 57*a* of the adjuster 57. A through hole 57*b* is formed at the center of the adjuster 57 and extends in the axial direction.

A columnar fitting projection 57*c* is formed at the lower surface of the adjuster 57. Another columnar fitting projection 58*a* is formed on the upper surface of the dolly block 58. The upper end of the adjuster spring 59 is fitted to the fitting projection 57*c* of the adjuster 57. The lower end of the adjuster spring 59 is fitted to the fitting projection 58*a* of the dolly block 58.

A force of the adjuster spring 59 exerted in a direction to urge the diaphragm 55 is varied in accordance with the axial position of the adjuster 57 in the case 56. This adjusts the characteristics of the control valve 1. More specifically, a tool is inserted from the ceiling hole 64 during manufacturing of the pressure sensing mechanism 11 to adjust the position of the adjuster 57. The case 56 is calked after adjusting the position of the adjuster 57. In this step, part of the case 56 projects inward to form the engaging projection 56*b*. Then, the engaging projection 56*b* is engaged with the engaging groove 57*a* of the adjuster 57. As a result, the length of the adjuster spring 59, or the urging force, is adjusted. In this manner, the control valve 1 is adjusted to obtain desired characteristics.

After fixing the adjuster 57, the pressure sensing mechanism 11 is exposed to the predetermined standard pressure. For example, the pressure sensing mechanism 11 is arranged in a pressure chamber having the standard pressure. The pressure in the control chamber 63 is smoothly balanced with the pressure in the pressure chamber via the ceiling hole 64 and the through hole 57*b*. The pressure in the control chamber 63 is then set to the standard pressure. In this state, the ceiling hole 64 is closed by the ceiling body 65. The control chamber 63 is tightly closed by welding the ceiling body 65 to the case 56.

The upper end of the pressure sensing shaft 21 abuts against the lower surface of the diaphragm 55. The pressure sensing chamber 46 is exposed to the suction pressure Ps as described above. When the suction pressure Ps is relatively high, the diaphragm 55 is displaced upward against the force of the adjuster spring 59. In contrast, when the suction pressure Ps is relatively low, the diaphragm 55 is displaced downward by the force of the adjuster spring 59 and the pressure difference between the pressure in the control chamber 63 and the suction pressure Ps. That is, the diaphragm 55 is displaced in accordance with the suction pressure Ps.

The displacement of the diaphragm 55 is transmitted to the plunger 19 via the pressure sensing shaft 21 and is further transmitted to the valve body 38 via the rod 39, which is inserted in the plunger 19. Therefore, the displacement amount of the diaphragm 55 relates to the opening degree of the valve hole 34. The level of increase of the repulsive force of the diaphragm 55 is described by a quadratic curve and not by a straight line. Therefore, in the preferred embodiment, the initial displacement amount of the diaphragm 55 is strictly controlled by the adjuster 57.

The pressure sensing shaft 21 includes a stopper 21*b*, which projects in the radial direction. When the stopper 21*b* abuts against the upper end of the stationary core 18, the pressure sensing shaft 21 is prevented from moving downward.

The operation of the control valve 1 will now be described.

When exciting current is supplied from the electric supply line 23 to excite the coil 16, the coil 16 forms a magnetic circuit among a magnetic circuit member, which is the stationary core 18, the plunger 19, the solenoid cover 17, and the yoke 61. At this time, an attraction force that corresponds to the level of the exciting current (more specifically, approximately 0.2A to 0.7A) is generated between the stationary core 18 and the plunger 19. The plunger 19 is then attracted to the stationary core 18 against the force of the spring 22. As a result, the valve body 38, which is coupled to the rod 39, moves upward. When the coil 16 is excited, the plunger 19 constantly abuts against the pressure sensing shaft 21. In this state, the plunger 19 and the pressure sensing shaft 21 moves integrally with each other. The diaphragm 55 is displaced in accordance with fluctuation of the suction pressure Ps introduced into the pressure sensing chamber 46. The displacement of the diaphragm 55 is transmitted to the valve body 38 via the pressure sensing shaft 21, the plunger 19, and the rod 39. Therefore, the opening degree of the control valve 1, or the valve hole 34, is determined in accordance with the attraction force generated between the stationary core 18 and the plunger 19 in the solenoid 12 and the force based on the displacement of the diaphragm 55 in the pressure sensing mechanism 11.

When the excitation current supplied to the coil 16 is increased in accordance with the refrigeration load applied to the refrigerant circuit, the attraction force between the stationary core 18 and the plunger 19 increases. Therefore, force that decreases the opening degree of the valve hole 34 increases. Thus, the valve body 38 is selectively opened and closed by a suction pressure Ps that is lower than the suction pressure Ps before the exciting current is increased. In other words, when the exciting current is relatively large, the control valve 1 operates to maintain the suction pressure Ps to be lower than the suction pressure Ps before the exciting current is increased.

When the opening degree of the valve body 38 decreases, the amount of refrigerant gas that flows into the crank chamber 5 via the supply passage 6 from the discharge chamber 4 decreases, which decreases the crank pressure Pc. Accordingly, the inclination angle of the swash plate in the crank chamber 5 increases.

When the valve body 38 completely closes the valve hole 34, the supply passage 6 is closed. Therefore, the pressurized refrigerant gas in the discharge chamber 4 is not supplied to the crank chamber 5. The crank pressure Pc then becomes substantially the same as the suction pressure Ps and the inclination angle of the swash plate in the crank chamber 5 is maximized. In this case, the displacement of the compressor 2 is maximum.

In contrast, when the excitation current supplied to the coil 16 decreases, the attraction force between the stationary core 18 and the plunger 19 decreases. Therefore, the force that reduces the opening degree of the valve body 38 is decreased, and the valve body 38 is selectively opened and closed by a suction pressure Ps that is higher than the suction pressure Ps before the exciting current is decreased. In other words, when the current value is decreased, the control valve 1 is operated to maintain the suction pressure Ps to be higher than the suction pressure Ps before the exciting current is decreased.

When the opening degree of the valve body 38 increases, the amount of refrigerant gas that flows into the crank chamber 5 from the discharge chamber 4 increases, which increases the crank pressure Pc. The inclination angle of the swash plate in the crank chamber 5 decreases in accordance with the increase of the crank pressure Pc.

When the supply of exciting current to the coil 16 is stopped, the attraction force between the stationary core 18 and the plunger 19 is eliminated. This causes the valve body 38 to move to a position where the valve hole 34 is fully opened. Therefore, pressurized refrigerant gas in the discharge chamber 4 is supplied to the crank chamber 5 via the supply passage 6 by a large amount, which increases the crank pressure Pc. When the crank pressure Pc is increased, the inclination angle of the swash plate is minimized.

As described above, the control valve 1 is operated in accordance with the exciting current of the coil 16. In other words, the control valve 1 changes a target value of the suction pressure Ps in accordance with the exciting current. When the exciting current is great, the valve hole 34 is opened by a relatively low suction pressure Ps. When the exciting current is relatively small, the valve hole 34 is opened by a relatively high suction pressure Ps. The compressor 2 varies the displacement to maintain a predetermined suction pressure Ps.

The preferred embodiment provides the following advantages.

The control valve 1 has the diaphragm 55, which is manufactured at a lower cost than the conventional bellows. Therefore, the manufacturing cost of the control valve 1 is reduced.

The first flange 15*c* is formed integrally with the end of the plunger tube 15, which forms part of the solenoid 12. The diaphragm 55 is supported by the first flange 15*c*. In this case, as compared to a case where a support member for supporting the diaphragm 55 is separately formed and secured to the solenoid 12, the error of the fixing position of the diaphragm 55 with respect to the valve hole 34 is reduced. That is, since there is no dimensional error or assembling error of the supporting member, the distance D between the diaphragm 55 and the valve hole 34 (the ceiling 32*a* of the valve chamber 32) is set with high accuracy.

The plunger tube 15 extends along the entire length of the solenoid 12. The lower end of the plunger tube 15, that is, the end of the plunger tube 15 that is opposite to the pressure sensing mechanism 11 is secured to the valve housing 31 of the valve mechanism 13. With this structure, the distance D between the diaphragm 55 and the valve hole 34 is determined by the dimension of the plunger tube 15 and the valve housing 31. Thus, the number of parts, which cause dimensional errors, is few and the dimensional error of the fixing position of the diaphragm with respect to the valve hole 34 is reduced.

The stopper 21*b* is formed on the pressure sensing shaft 21. When the stopper 21*b* abuts against the end of the stationary core 18, the downward movement of the pressure sensing shaft 21 is restricted. Therefore, the diaphragm 55 is prevented from being displaced downward unnecessarily. Thus, the durability of the diaphragm 55 is maintained.

The first and second communication grooves 19*b*, 18*c* are formed on the circumferential surface of the stationary core 18 and the plunger 19, respectively. The suction pressure Ps is introduced into the pressure sensing chamber 46, which is located below the diaphragm 55, through the first and second communication grooves 19*b*, 18*c*. In this case, since refrigerant gas that has a relatively low temperature passes along the axial direction of the entire solenoid 12, the cooling efficiency is high.

The spring 22 is located between the pressure sensing shaft 21 and the plunger 19. When exciting current is not supplied to the coil 16, the spring 22 presses the valve body 38 via the plunger 19 to open the valve hole 34. With this structure, in the case where current supply to the coil 16 is stopped when the suction pressure Ps is high and the diaphragm 55 is displaced upward against the force of the adjuster spring 59, the spring 22 extends to depress the plunger 19. Although the spring 22 is extended, the pressure sensing shaft 21 does not separate from the diaphragm 55. That is, the pressure sensing shaft 21 always abuts against the diaphragm 55. This prevents the fatigue of the diaphragm 55 caused when the pressure sensing shaft 21 repeatedly abuts against and separates from the diaphragm 55, and improves the durability of the diaphragm 55.

The pressure sensing mechanism 11 has the adjuster 57. The axial position of the adjuster 57 adjusts the force of the adjuster spring 59, which controls the characteristics of the control valve 1.

The sealing plate 52 is attached to the rod 39 and separates the inside of the plunger tube 15 from the valve hole 34. The rod 39 is supported by the plunger 19 and the sealing plate 52. Thus, the rod 39 (the valve body 38) smoothly moves in the valve housing 31.

It should be apparent to those skilled in the art that the present invention may be embodied in many other specific forms without departing from the spirit or scope of the invention. Particularly, it should be understood that the invention may be embodied in the following forms.

On the contrary to the embodiment shown in FIG. 1, the valve chamber 32 may be connected to the discharge chamber 4 via the upstream portion of the supply passage 6 and the valve hole 34 may be connected to the crank chamber 5 via the downstream portion of the supply passage 6.

The second communication groove 18*c*, which extends in the axial direction, need not be formed on the outer circumferential surface of the stationary core 18. A groove that extends in the axial direction may be formed between the stationary core 18 and the pressure sensing shaft 21. More specifically, for example, a groove may be formed on the circumferential surface of the pressure sensing shaft 21, or on the inner circumferential surface of the stationary core 18. In this case also, the suction pressure Ps is introduced into the pressure sensing chamber 46.

The present examples and embodiments are to be considered as illustrative and not restrictive and the invention is not to be limited to the details given herein, but may be modified within the scope and equivalence of the appended claims.

What is claimed is:

1. A control valve for a variable displacement compressor, wherein the compressor includes a discharge pressure zone, a suction pressure zone, a crank chamber, and a supply passage, which communicates the discharge pressure zone with the crank chamber, and wherein a control valve is located in the supply passage and controls the displacement of the compressor by adjusting the pressure in the crank chamber, the control valve comprising:

a solenoid, wherein the solenoid has a first end and a second end, and wherein the solenoid has a cylindrical body and a coil, which is located about the cylindrical body;

a pressure sensing mechanism located on the first end of the solenoid, wherein the pressure sensing mechanism has a pressure sensing chamber and a diaphragm, wherein the pressure in the suction pressure zone is introduced into the pressure sensing chamber, and wherein the diaphragm is displaced in accordance with the pressure in the pressure sensing chamber; and a valve mechanism located on the second end of the solenoid, wherein the valve mechanism has a valve hole, which forms part of the supply passage, and a valve body, which selectively opens and closes the valve hole in accordance with displacement of the diaphragm, and wherein the cylindrical body has a support end, which supports the diaphragm.

2. The control valve according to claim 1, wherein a flange for supporting the diaphragm is formed on the support end of the cylindrical body.

3. The control valve according to claim 1, wherein the solenoid has an axial length, wherein the cylindrical body extends along that entire axial length, and wherein the valve mechanism is secured to an end of the cylindrical body opposite to the support end of the cylindrical body.

4. The control valve according to claim 1, further comprising:

a plunger located inside the cylindrical body to be movable in an axial direction of the cylindrical body, wherein the plunger is coupled to the valve body;

a stationary core located inside the cylindrical body, said stationary core being located between the plunger and the pressure sensing mechanism, wherein, when the coil is excited, the stationary core attracts the plunger; and a pressure sensing shaft located inside the cylindrical body, which pressure sensing shaft abuts against the diaphragm, wherein the pressure sensing shaft transmits the displacement of the diaphragm to the valve body via the plunger, and wherein the pressure sensing shaft has a stopper, which engages with the stationary core to restrict axial movement of the pressure sensing shaft.

5. The valve body according to claim 4, wherein the plunger and the stationary core each has a communication groove, which extends in the axial direction of the cylindrical body, and wherein the communication grooves communicate the suction pressure zone with the pressure sensing chamber.

6. The control valve according to claim 1, further comprising:

a plunger located inside the cylindrical body to be movable in the axial direction of the cylindrical body, wherein, when the coil is excited, the plunger urges the valve body in a direction to close the valve hole;

a pressure sensing shaft, which abuts against the diaphragm, wherein the pressure sensing shaft transmits displacement of the diaphragm to the valve body via the plunger; and a spring located between the plunger and the pressure sensing shaft, wherein, when the coil is not excited, the spring presses the valve body with the plunger to cause the valve body to open the valve hole.

7. The control valve according to claim 1, wherein the pressure sensing mechanism further includes an urging member, which uses an urging force to urge the diaphragm in one direction, and an adjuster for adjusting the urging force of the urging member.

8. The control valve according to claim 1, further comprising:

a plunger located inside the cylindrical body to move in the axial direction of the cylindrical body by excitation of the coil;

a rod located between the valve mechanism and the plunger, wherein the rod is coupled to the plunger; and an annular sealing member attached to the rod, wherein the sealing member separates an inner portion of the cylindrical body from the valve hole.

9. The control valve according to claim 1, wherein the pressure sensing chamber is defined by a portion of the cylindrical body in the vicinity of the support end and the diaphragm.

10. A control valve for a variable displacement compressor, wherein the compressor includes a discharge pressure zone, a suction pressure zone, a crank chamber, and a supply passage, which communicates the discharge pressure zone with the crank chamber, and wherein a control valve is located in the supply passage and controls the displacement of the compressor by adjusting the pressure in the crank chamber, the control valve comprising:

a solenoid, wherein the solenoid has a first end and a second end, and wherein the solenoid has a cylindrical body, which has a first flange on one end, and a coil, which is located about the cylindrical body;

a pressure sensing mechanism located on the first end of the solenoid, wherein the pressure sensing mechanism includes a cylindrical case, which has a second flange, a pressure sensing chamber, to which pressure in the suction pressure zone is introduced; and a diaphragm, which is displaced in accordance with the pressure in the pressure sensing chamber, wherein the diaphragm is sandwiched between the first and second flanges; and a valve mechanism located on the second end of the solenoid, wherein the valve mechanism has a valve hole, which forms part of the supply passage, and a valve body, which selectively opens and closes the valve hole in accordance with the displacement of the diaphragm.

11. The control valve according to claim 10, wherein the solenoid has an axial length, wherein the cylindrical body extends along that entire axial length, and wherein the valve mechanism is secured to an end of the cylindrical body located opposite to the first flange of the cylindrical body.

12. The control valve according to claim 10, further comprising:

a plunger located inside the cylindrical body to be movable in the axial direction of the cylindrical body, wherein the plunger is coupled to the valve body;

a stationary core located inside the cylindrical body, said stationary core being located between the plunger and the pressure sensing mechanism, wherein, when the coil is excited, the stationary core attracts the plunger; and a pressure sensing shaft located inside the cylindrical body, which pressure sensing shaft abuts against the diaphragm, wherein the pressure sensing shaft transmits displacement of the diaphragm to the valve body via the plunger, and wherein the pressure sensing shaft has a stopper, which engages with the stationary core to restrict axial movement of the pressure sensing shaft.

13. The valve body according to claim 12, wherein the plunger and the stationary core each has a communication groove, which extends in the axial direction of the cylindrical body, and wherein the communication grooves communicate the suction pressure zone with the pressure sensing chamber.

14. The control valve according to claim 10, further comprising:

a plunger located inside the cylindrical body to be movable in the axial direction of the cylindrical body, wherein, when the coil is excited, the plunger urges the valve body in a direction to close the valve hole;

a pressure sensing shaft, which abuts against the diaphragm, wherein the pressure sensing shaft transmits displacement of the diaphragm to the valve body via the plunger; and a spring located between the plunger and the pressure sensing shaft, wherein, when the coil is not excited, the spring presses the valve body with the plunger to cause the valve body to open the valve hole.

15. The control valve according to claim 10, wherein the pressure sensing mechanism further includes an urging member, which uses an urging force to urge the diaphragm in one direction, and an adjuster for adjusting the urging force of the urging member.

16. The control valve according to claim 10, further comprising:

a plunger located inside the cylindrical body to move in the axial direction of the cylindrical body by excitation of the coil;

a rod located between the valve mechanism and the plunger, wherein the rod is coupled to the plunger; and an annular sealing member attached to the rod, wherein the sealing member separates an inner portion of the cylindrical body from the valve hole.

17. The control valve according to claim 10, wherein the pressure sensing chamber is defined by a portion of the cylindrical body in the vicinity of the first flange and the diaphragm.

* * * * *